US007470084B2

(12) United States Patent
Brotzel

(10) Patent No.: US 7,470,084 B2
(45) Date of Patent: Dec. 30, 2008

(54) ERGONOMIC CONCRETE HAND SCREED

(75) Inventor: Norman Brotzel, Falkland (CA)

(73) Assignee: Precise Tech Industries Ltd., Westbank, British Columbia (CA)

( * ) Notice: Subject to any disclaimer, the term of this patent is extended or adjusted under 35 U.S.C. 154(b) by 0 days.

(21) Appl. No.: 11/679,711

(22) Filed: Feb. 27, 2007

(65) Prior Publication Data

US 2007/0206992 A1 Sep. 6, 2007

(30) Foreign Application Priority Data

Mar. 1, 2006 (CA) ..... 2538398

(51) Int. Cl.
*E01C 19/00* (2006.01)
*E01C 19/22* (2006.01)

(52) U.S. Cl. ..... 404/118; 404/83

(58) Field of Classification Search ..... 404/114, 404/118, 83

See application file for complete search history.

(56) References Cited

U.S. PATENT DOCUMENTS

| | | | | |
|---|---|---|---|---|
| 1,227,308 | A * | 5/1917 | Plank | 15/235.5 |
| 4,641,995 | A * | 2/1987 | Owens | 404/118 |
| 4,702,641 | A * | 10/1987 | Naser et al. | 404/97 |
| 5,609,437 | A * | 3/1997 | Silva | 404/118 |
| 6,231,331 | B1 * | 5/2001 | Lievers | 425/183 |

* cited by examiner

*Primary Examiner*—Raymond W Addie
(74) *Attorney, Agent, or Firm*—Dennis T. Griggs

(57) ABSTRACT

An ergonomically-shaped hand screed for levelling and finishing concrete is provided. The screed has a finger relief groove on its rear face and a thumb relief groove on its front face. Both the finger and thumb grooves are positioned nearer the top surface of the screed to form an ergonomically comfortable handgrip. A concrete relief groove is located on the front face near the bottom surface to form a scraper edge. A ridge separates the thumb relief groove and the concrete groove. When the screed is used, the scraper edge and concrete relief groove draw up the concrete overburden from a concrete surface and deflect it away from the operator's hands.

16 Claims, 7 Drawing Sheets

ERGONOMIC CONCRETE HAND SCREED

FIELD OF THE INVENTION

The present invention relates to hand screeds used in concrete finishing and levelling. More particularly, the present invention relates to hand screeds with an ergonomic shape that is more comfortable to hold.

BACKGROUND OF THE INVENTION

In the concrete industry, "screeding-boards" are common tools used to level concrete that has been freshly poured. For the purposes of this specification and the claims contained herein, the term "plastic concrete" shall refer to freshly-poured concrete that has not yet set up and hardened.

The types of screeds used in levelling plastic concrete vary from planks of wood, such as "2×4's", which are manually pushed or pulled through the concrete, to mechanical screeds which are powered. Often, the type of screed used depends on the size and complexity of the surface area to be levelled.

Manual screeds continue to be used in the majority of concrete projects. Manual screeds are necessarily used for small surface areas, slopes and around difficult spaces such as drains and columns. However, conventional manual screeds are laborious to use and difficult to manoeuvre through the concrete. Conventional manual screeds are also problematic due to difficulties consistently and accurately maintaining the screed level throughout the screeding process.

The use of 2×4 wooden timbers or metal bars of similar dimensions are not ergonomically comfortable or healthy for an operator to use over extended periods of time. It is, therefore, desirable to provide a hand screed that is ergonomically shaped, that reduces health risks to operators and that is comfortable to hold and use in levelling freshly poured concrete.

SUMMARY OF THE INVENTION

The present invention is a hand screed for finishing and leveling concrete that is asymmetrically and ergonomically shaped, safe and comfortable to hold and use. The screed comprises a longitudinal body having two ends. The height of the body, typically, is greater in dimension than the width of the body. In representative embodiments of the present invention, the height is about 4" whereas the width is about 2". These relative dimensions can be scaled upwards or downwards proportionately in dimension to cater to the size of a screed operator's hands.

The screed has a front face, which faces toward the operator when in use, and a rear face that faces away from the operator. The body further has a top surface that has adapted to form a handgrip, and a bottom surface that is adapted for screeding plastic concrete. The bottom surface is substantially flat and square to leave a level surface as the screed is drawn along the plastic concrete.

Running at least partially lengthwise along the rear face is a finger relief groove located near the top surface. This groove is a slight concave depression along the rear face that is adapted to receive an operator's fingers as the top surface of the screed is gripped. In addition, a concrete relief groove runs at least partially lengthwise along the front face near the bottom surface. The concrete relief groove is a concave depression that intersects with the bottom surface to form a scraper edge. In operation, the hand screed is drawn along a surface of plastic concrete. The scraper edge draws up excess concrete overburden and curls it up and away from the concrete surface being finished and levelled.

In other embodiments of the present invention, the front face further comprises a thumb relief groove running at least partially lengthwise along the front face along the top surface. The thumb relief groove is a concave depression that provides a place for an operator to put their thumbs comfortably as the screed is gripped. In representative embodiments of the present invention, the thumb relief groove may run parallel to the top surface of the screed. The intersection of the thumb relief groove and the concrete relief groove forms a ridge that runs lengthwise along the front face separating these grooves. The ridge acts to deflect concrete overburden drawn out from the screeding process away from the operator's hands. This is advantageous as concrete may contain chemicals that can be harmful to the operator's hand if they choose to screed the concrete without wearing gloves. Many operators have experienced burns to their hands and thumbs from plastic concrete while levelling and finishing the concrete.

The body of the hand screed may be made of wood, metal or high density plastic, as well known to those skilled in the art. If the body is made of wood, the screed may further comprise a wear plate on the bottom surface made of metal or plastic to bear the brunt of the abrasive effects of screeding concrete. Alternatively, the body may be made of extruded metal or plastic. Accordingly, a wear plate also made of extruded metal or plastic, and that is further adapted to fasten to the body, may be used. As the wear plate becomes worn beyond useful service, it can be simply removed from the body and be replaced with a new one.

In further embodiments, the screed may comprise a mounting groove for running lengthwise along the top surface and which is adapted to mounting auxiliary equipment thereon. This may include bubble levels or laser levelling devices to aid the operator in screeding plastic concrete. When not in use, a cap that is operatively attached to the top surface to enclose the mounting groove may be used to keep out dirt and debris. The cross-sectional shape of the screed allows auxiliary items to be clamped to the top surface of the screed. These items may include a handgrip or the like to allow an operator to work the screed with their hands in an elevated position. The handgrip may take any form that is comfortable to hold such as a pistol-style grip.

Broadly stated, one aspect of the present invention is a hand screed, comprising a longitudinal body of the predetermined length, said body having two ends, a front face, a rear face, a bottom surface adapted for screeding plastic concrete, and a top surface adapted to form a hand grip at least partially along said length, said body having a height that is greater in dimension than the width of said body; and a concrete relief groove disposed on said front face, said concrete relief groove is extending at least partially along said length between said ends, said concrete relief groove positioned nearer said bottom surface whereby a scraper edge is formed at least partially along said length whereas said front face intersects with said bottom surface.

Broadly stated, another aspect of the present invention is a hand screed, comprising a longitudinal body of the predetermined length, said body having two ends, a front face, a rear face, a bottom surface, and a top surface adapted to form a hand grip at least partially along said length, said body having a height that is greater in dimension that the width of said body; a wear plate operatively attached to said bottom surface along at least a portion of said length of said body, a said wear plate forming a portion of said front face and said rear face; and a concrete relief groove disposed on said front face and said wear plate, said concrete relief groove extending at least partially along said length between said ends, said concrete relief groove positioned near said bottom surface whereby a scraper edge is formed at least partially along said length.

DETAILED DESCRIPTION OF THE EMBODIMENTS

Figure 1:
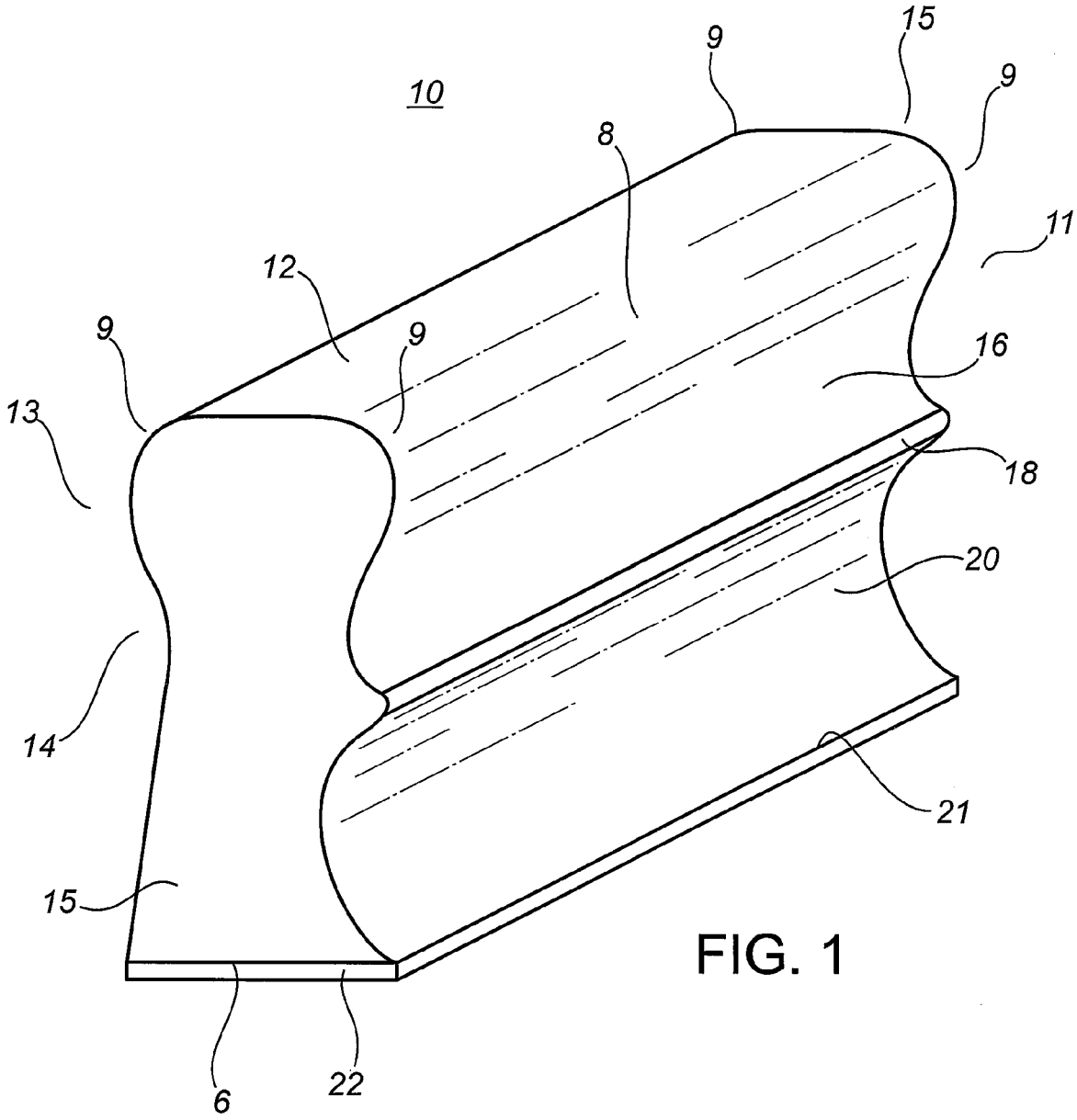
FIG. 1 is perspective view depicting a hand screed in accordance with a first representative embodiment of the present invention.
Figure 2:
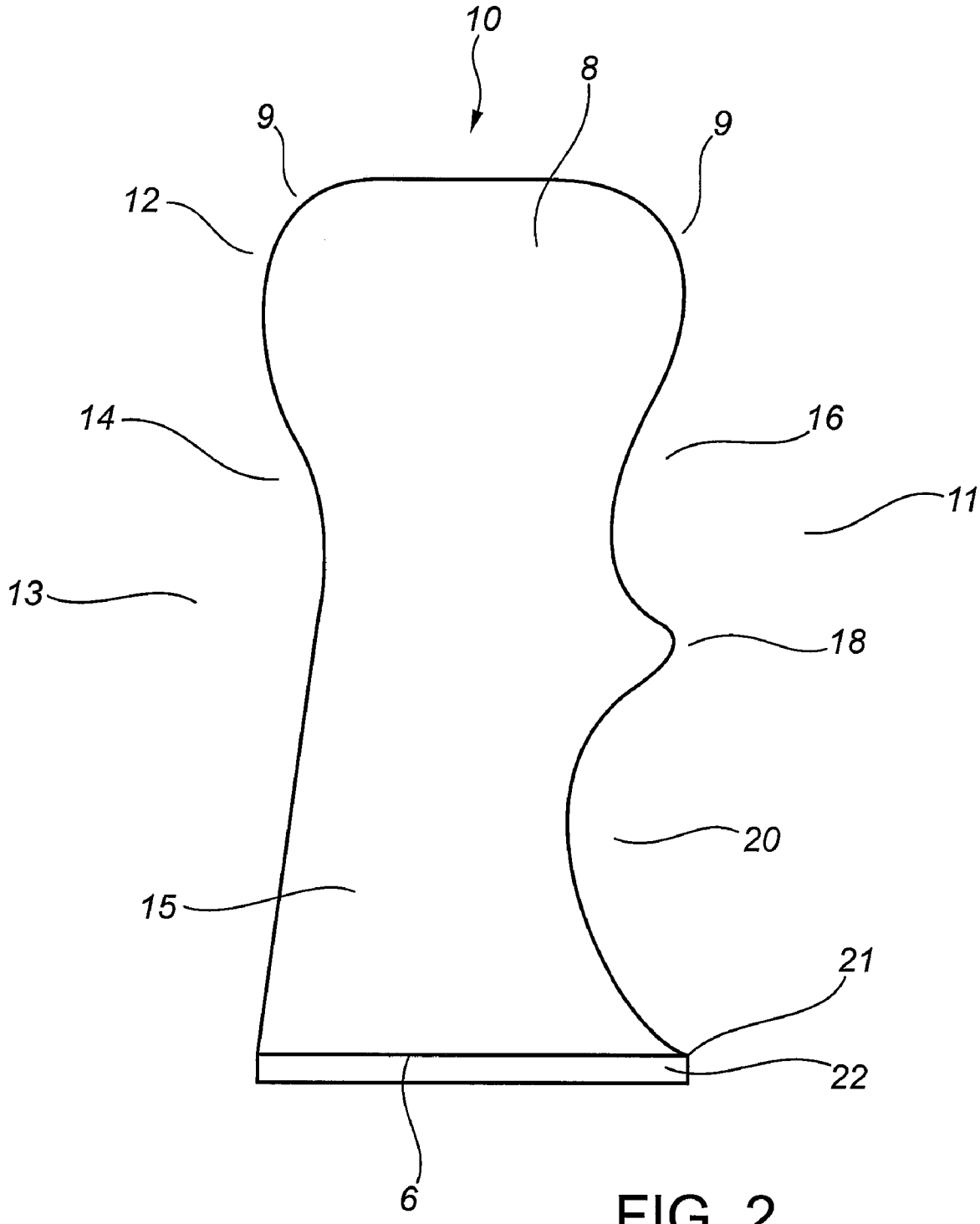
FIG. 2 is an end elevational view depicting the hand screed of FIG. 1.

The present invention is an ergonomically-shaped hand screed for manually finishing and leveling plastic concrete. Shown in FIGS. 1 and 2 is a first representative embodiment of the present invention. Hand screed 10 comprises longitudinal body 8 that is asymmetrical in cross-sectional shape and having top surface 12, bottom surface 6, front face 11, rear face 13 and end surfaces 15. The length of body 8 may be of any predetermined length. Screed 10 can be as long or as short as needed for particular location or application in screeding concrete, as determined by those skilled in the art. Longer lengths are suitable for larger areas of plastic concrete whereas shorter lengths may be used in smaller or tightly confined spaces. Top surface 12 has rounded shoulders 9. On rear face 13 is finger relief groove 14 that runs along the longitudinal length of body 8.

Finger groove 14 provides a place for an operator to place their fingers when gripping screed 10. Finger relief groove is a slightly concave depression along rear face 13. Thumb relief groove 16 runs lengthwise along front face 11. Thumb relief groove 16 is a concave depression shaped to comfortably receive an operator's thumb. Both finger relief groove 14 and thumb relief groove 16 are located nearer top surface 12 and act in a combination to provide a comfortable hand grip for screed 10.

Also running lengthwise along front face 11 are ridge 18 and concrete relief groove 20. Ridge 18 separates thumb relief groove 16 from concrete relief groove 20. Concrete relief groove 20 intersects with bottom surface 6 to form scraper edge 21. Wear plate 22 is operatively attached to bottom surface 6 to bear the brunt of the abrasive effect of screeding concrete. In this embodiment, wear plate 22 may be attached with screws or nails or any other suitable fastener as well known by those skilled in the art. Screed 10, preferably but not essentially, has a height greater in dimension than its width. A representative example of screed 10 has a height of about 4" and a width of about 2". However the height can range from about 3" to about 6" and a width can range from about 1½" to about 3".

Body 8 may be made of wood, metal or plastic. If made of metal or plastic, body 8 can be made from an extruded metal or plastic to minimize the weight of screed 10 but still retain structural rigidity suitable for a hand screed. Example materials for body 8 can include aluminum, magnesium and high density polyethylene plastic although other suitable materials can be used as known to those skilled in the art. Wear plate 22 can be made of metal, high density polyethylene plastic or any other suitable material having abrasive wear properties suitable for screeding plastic concrete as well known to those skilled in the art.

Figure 3:
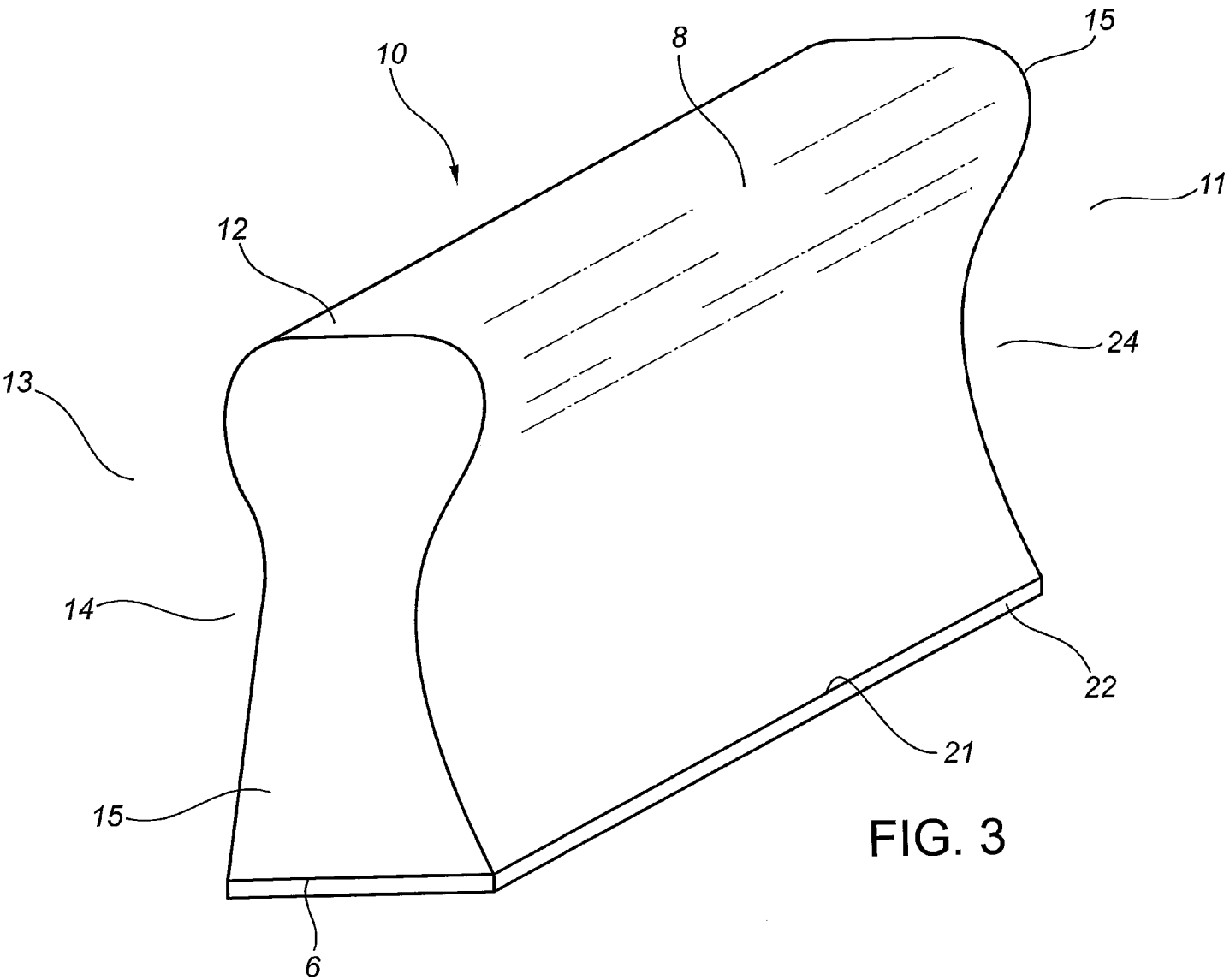
FIG. 3 is perspective view depicting a hand screed in accordance with a second representative embodiment of the present invention.

Referring to FIG. 3, a second representative embodiment of the present invention is illustrated. This embodiment is similar to the first described embodiment except that it does not have thumb relief groove 16 or ridge 18 along front face 11. Instead, there is a single relief groove 24 running lengthwise along front face 11. In all other aspects, this second representative embodiment is similar to that of the first embodiment.

Figure 4:
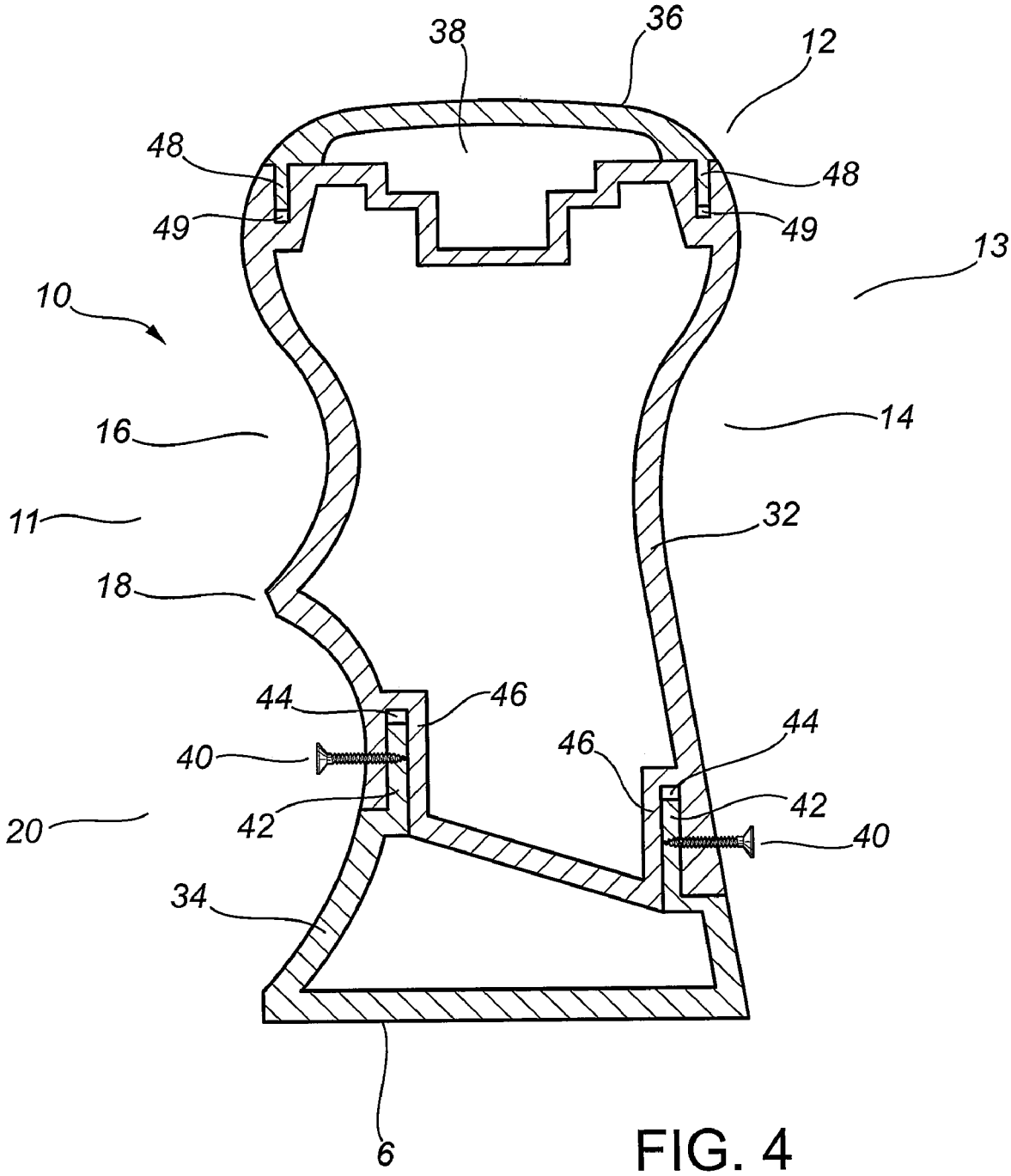
FIG. 4 is a cross-sectional end elevational view depicting a hand screed in accordance with a third representative embodiment of the present invention.

Referring to FIG. 4, a cross-sectional view of a third representative embodiment of the present invention is illustrated. In this embodiment, screed 10 is similar in shape to the first embodiment shown in FIGS. 1 and 2 but is made using extruded materials. Body 32 is an extruded tube having finger relief groove 14 on rear face 13 and thumb relief groove 16 and ridge 18 on front face 11. Wear plate 34 is an extruded U-shaped member that comprises bottom surface 6. Tongues 42 on rear plate 34 slide in grooves 44 and body 32 and are secured by screws 40 passing through tongues 42 into sidewalls 46. In this embodiment, wear plate 34 in combination with body 32 form concrete relief groove 20.

Also illustrated in this embodiment is optional mounting groove 38 located on top surface 12. Mounting groove 38 provides a location for mounting auxiliary equipment such as bubble levels (not shown) or laser levelling devices (not shown). When not in use, cap 36 covers mounting groove 38 by having tongues 48 inserted into grooves 49 which are held in place by friction.

Figure 5:
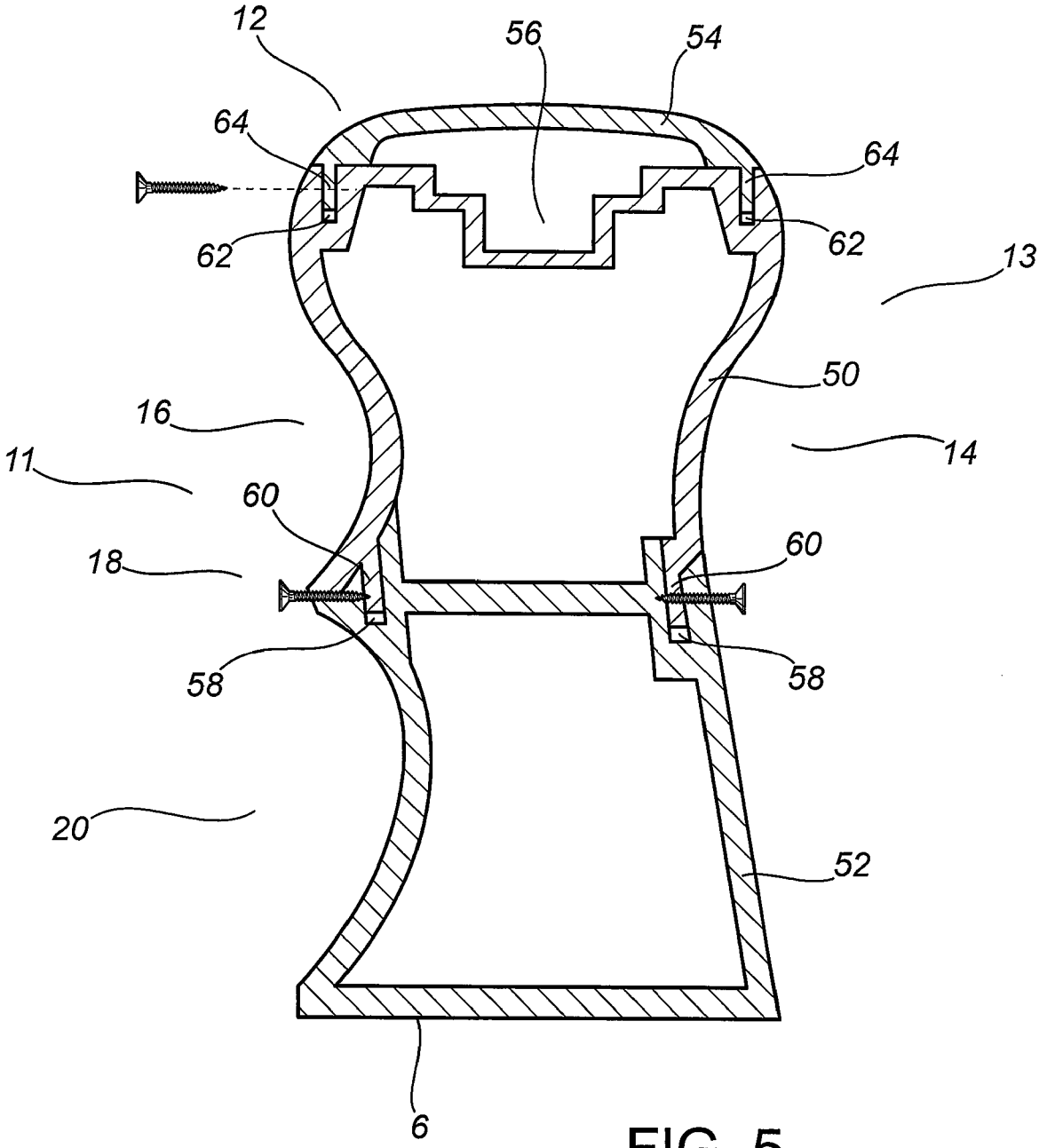
FIG. 5 is cross-sectional end elevational view depicting a hand screed in accordance with a fourth representative embodiment of the present invention.

Referring to FIG. 5, a cross-sectional view of a fourth representative embodiment of the present invention is illustrated. This embodiment is similar in overall cross-sectional shape to the third embodiment but the sub components differ in construction. In this fourth embodiment, body 50 is an extruded inverted U-shaped member and wear plate is an extruded box-shaped member. Tongues 60 of body 50 slide into grooves 58 of wear plate 52 and are secured by screw 66. This embodiment also illustrates mounting groove 56 covered by cap 54 by having tongue 64 fitted into groove 62 and secured by screw 68. In all other aspects, this embodiment is similar in shape and function as the embodiments shown in FIGS. 1, 2 and 4.

Figure 6:
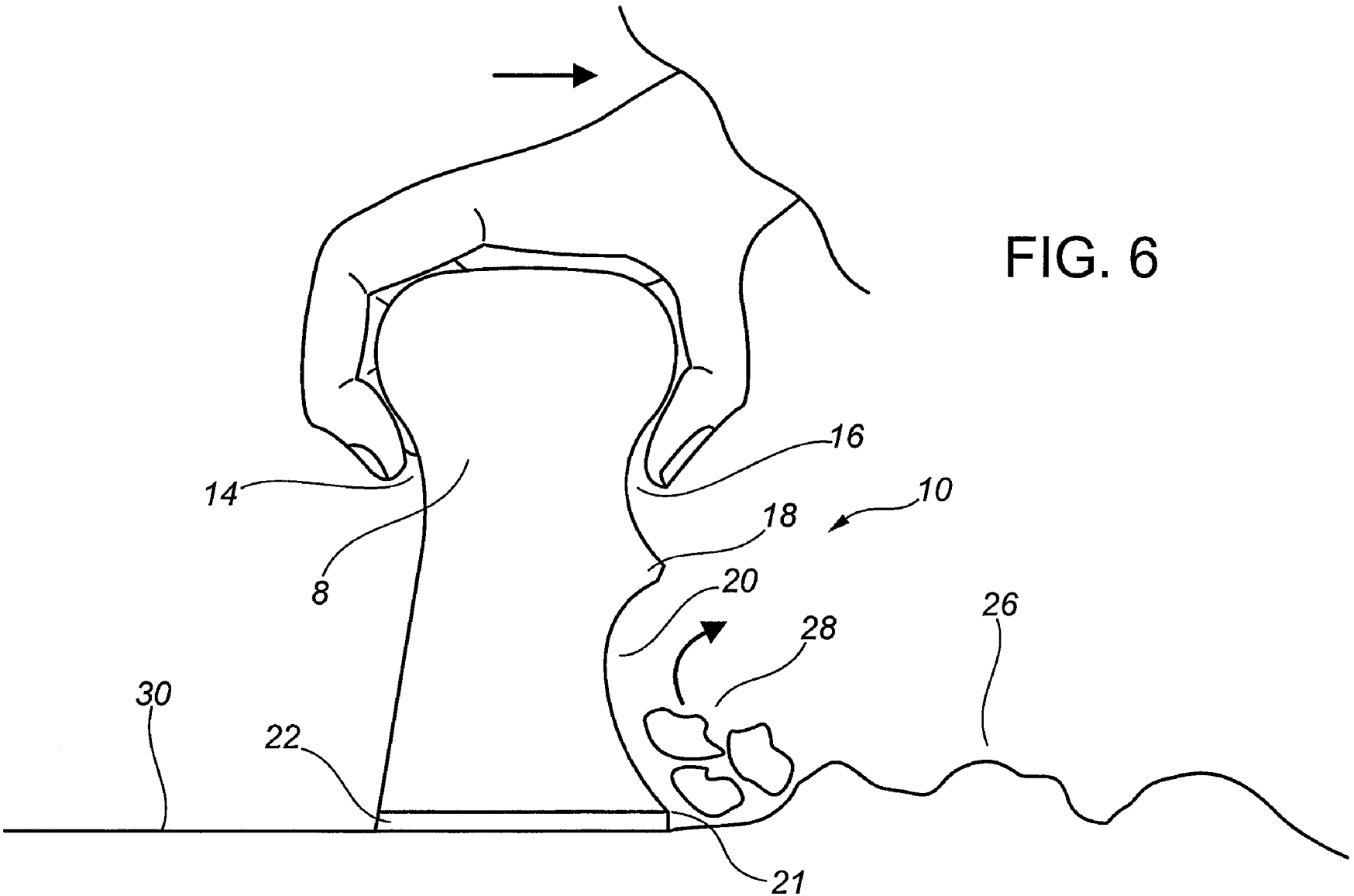
FIG. 6 is an end elevational view depicting the hand screed of FIG. 1 in use levelling concrete.

Referring to FIG. 6, the first representative embodiment of the present invention is shown in operation. Hand screed 10 is gripped by an operator's hands that draws screed 10 along unfinished concrete 26. In doing so, concrete overburden 28 is drawn up by scraper edge 21 and deflected away by concrete relief groove 20. Ridge 18 deflects overburden 28 from the operator's thumb resting on thumb relief groove 16. This process is carried out repeatedly over unfinished concrete 26 until it becomes levelled concrete surface 30.

Figure 7:
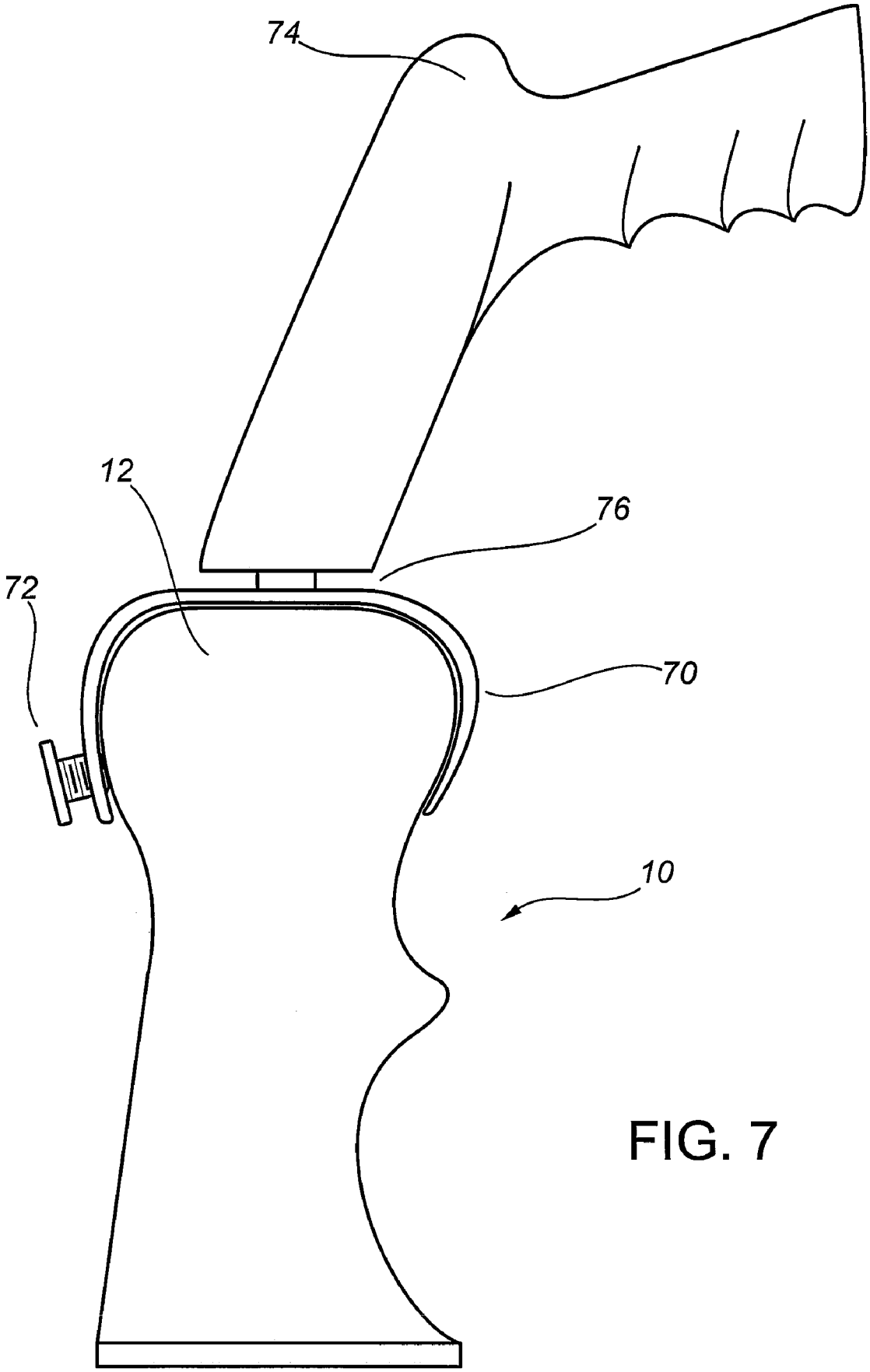
FIG. 7 is an end elevational view depicting the hand screed of FIG. 1 including an auxiliary pistol grip attached thereon.

Referring to FIG. 7, a representative embodiment of the present invention is shown with an auxiliary handgrip attached thereto. The cross-sectional shape of screed 10 is suitable for attaching an external clamp for a handgrip. In this example, clamp 70 is c-shaped member that slides onto hand rail 12 from either end of screed 10 and is secured at a desired position by tightening thumbscrew 72 or by any other suitable means as known to those skilled in the art. Handgrip 74 is operatively attached to clamp 70 at pivot point 76. Handgrip 74 may be configured to pivot with respect to clamp 70 at pivot point 76 to provide additional flexibility in working screed 10. In this particular example, handgrip 74 is shown having a pistol grip shape although it should be obvious to those skilled in the art that handgrip 74 may have any shape that is comfortable to grasp.

Although a few preferred embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

I claim:

1. A hand screed, comprising:

a) a longitudinal body of a predetermined length, said body having two ends, a front face, a rear face, a bottom surface adapted for screeding plastic concrete, and a top surface adapted to form a hand grip at least partially along said length, said body asymmetrical in cross-sectional shape and having a height that is greater in dimension than the width of said body; and b) a concrete relief groove disposed on said front face, said concrete relief groove extending at least partially along said length between said ends, said concrete relief groove positioned nearer said bottom surface whereby a scraper edge is formed at least partially along said length where said front face intersects with said bottom surface a thumb relief groove disposed on said front face, said thumb relief groove extending at least partially along said length between said ends, said thumb relief groove positioned nearer said top surface thereby forming at least a portion of said hand grip, with a ridge being formed at least partially along the length of said front face between said thumb relief groove and said concrete relief groove.

2. The hand screed as set forth in claim 1 wherein the height of said body is about twice the dimension of the width of said body.

3. The hand screed as set forth in claim 1 wherein the height of said body is in the range of about 3" to about 6", and the width of said body is in the range of about 1½" to about 3".

4. The hand screed as set forth in claim 1 further comprising a wear plate adapted for screeding plastic concrete releasably attached to at least a portion of said bottom surface thereby forming at least a portion of said scraper edge.

5. A hand screed as set forth in claim 1 further comprising a finger relief groove disposed on said rear face, said finger relief groove extending at least partially along said length between said ends, said finger relief groove positioned nearer said top surface thereby forming at least a portion of said hand grip.

6. The hand screed as set forth in claim 1 wherein said body is made of extruded metal or extruded plastic or wood.

7. The hand screed as set forth in claim 4 wherein said wear plate is made of metal or plastic.

8. A hand screed, comprising:

a) a longitudinal body of a predetermined length, said body having two ends, a front face, a rear face, a bottom surface, and a top surface adapted to form a hand grip at least partially along said length, said body asymmetrical in cross-sectional shape and having a height that is greater in dimension than the width of said body;

b) a wear plate operatively attached to said bottom surface along at least a portion of said length of said body, said wear plate forming a portion of said front face and said rear face; and c) a concrete relief groove disposed on said front face and said wear plate, said concrete relief groove extending at least partially along said length between said ends, said concrete relief groove positioned near said bottom surface whereby a scraper edge is formed at least partially along said length; and a thumb relief groove disposed on said front face, said thumb relief groove extending at least partially along said length between said ends, said thumb relief groove positioned nearer said top surface thereby forming at least a portion of said hand grip, with a ridge being formed at least partially along the length of said front face between said thumb relief groove and said concrete relief groove.

9. The hand screed as set forth in claim 8 wherein the height of said hand screed is about twice the dimension of the width of said hand screed.

10. The hand screed as set forth in claim 8 wherein the height of said hand screed is in the range of about 3" to about 6" and the width of said hand screed is in the range of about 1½" to about 3".

11. The hand screed as set forth in claim 8 further comprising a finger relief groove disposed on said rear face, said finger relief groove extending at least partially along said length between said ends, said finger relief groove positioned nearer said top surface thereby forming at least a portion of said hand grip.

12. The hand screed as set forth in claim 8 further comprising at least one auxiliary handgrip operatively attached to said hand screed.

13. The hand screed as set forth in claim 12 wherein said at least one handgrip is a pistol grip operatively attached to said top surface of said hand screed.

14. The hand screed as set forth in claim 8 wherein said body is made of wood, metal or plastic and said wear plate is made of metal or plastic.

15. The hand screed as set forth in claim 14 wherein said body is made of extruded metal or extruded plastic.

16. The hand screed as set forth in claim 14 wherein said wear plate is made of extruded metal or extruded plastic.

* * * * *